US012497219B2

(12) United States Patent
Chen

(10) Patent No.: US 12,497,219 B2
(45) Date of Patent: Dec. 16, 2025

(54) CONTAINER LID AND CONTAINER

(71) Applicant: CHANGSHA ANXIANG MEDICAL TECHNOLOGY CO., LTD., Changsha (CN)

(72) Inventor: Junyuan Chen, Changsha (CN)

(73) Assignee: CHANGSHA ANXIANG MEDICAL TECHNOLOGY CO., LTD., Changsha (CN)

( * ) Notice: Subject to any disclaimer, the term of this patent is extended or adjusted under 35 U.S.C. 154(b) by 168 days.

(21) Appl. No.: 18/504,098

(22) Filed: Nov. 7, 2023

(65) Prior Publication Data

US 2024/0158141 A1 May 16, 2024

(30) Foreign Application Priority Data

Nov. 14, 2022 (CN) ..... 202223020599.4

(51) Int. Cl.

| | |
|---|---|
| ***B65D 47/26*** | (2006.01) |
| ***B65D 25/04*** | (2006.01) |
| ***B65D 47/06*** | (2006.01) |
| ***B65D 47/08*** | (2006.01) |

(52) U.S. Cl.

CPC ..... *B65D 47/265* (2013.01); *B65D 25/04* (2013.01); *B65D 47/06* (2013.01); *B65D 47/0857* (2013.01)

(58) Field of Classification Search

CPC ..... B65D 47/0857; B65D 47/0895; B65D 47/265; B65D 47/266; B65D 25/04; B65D 2583/049; B65D 2251/04; B65D 2543/0025; B65D 83/02; A47G 2019/122

USPC ..... 220/525, 523, 254.3; 222/142.9

See application file for complete search history.

(56) References Cited

U.S. PATENT DOCUMENTS 2,573,311 A * 10/1951 Cupler ..... B65D 83/02 206/382
2,765,094 A * 10/1956 Ryan ..... B65D 47/0895 215/DIG. 5
3,100,589 A * 8/1963 Love, Jr. ..... B65D 47/265 222/548

(Continued)

FOREIGN PATENT DOCUMENTS

AU 2021202698 A1 * 11/2022 ..... B65D 47/32
CN 217755010 U * 11/2022

OTHER PUBLICATIONS

Translation of CN-217755010-U (Year: 2022).*

*Primary Examiner* — Mollie Impink

(57) ABSTRACT

A container lid includes: a first lid body and a second lid body; wherein of two opposing end portions of the first lid body and the second lid body, an insertion wall is arranged at one end portion and an engagement wall is arranged at the other end portion, the insertion wall being inserted into engagement wall and rotatably connected to the engagement wall; wherein a first snap-fit portion is arranged on the insertion wall, and a plurality of second snap-fit portions are consecutively arranged on the engagement wall along a circumferential direction, such that the consecutively arranged plurality of second snap-fit portions are successively in snap-fit engagement with the first snap-fit portion when the insertion wall is rotated with respect to the engagement wall; and an opening is arranged in the second lid body, and the second lid body is configured to cause the opening to be rotated.

10 Claims, 8 Drawing Sheets

(56) References Cited

U.S. PATENT DOCUMENTS

| | | | | |
|---|---|---|---|---|
| 5,123,574 | A * | 6/1992 | Poulos | B65D 83/0409 222/362 |
| 6,488,187 | B2 * | 12/2002 | Sheffler | B65D 47/265 220/837 |
| 7,159,720 | B2 * | 1/2007 | Pearson | B65D 83/04 206/533 |
| 7,721,911 | B2 * | 5/2010 | Chou | B65D 47/265 215/310 |
| 8,955,705 | B2 * | 2/2015 | Vogel | B65D 47/265 220/253 |
| 9,976,891 | B1 * | 5/2018 | Fanton | G01F 11/42 |
| 11,986,108 | B1 * | 5/2024 | Rixter | B65D 45/325 |
| 2022/0151410 | A1 * | 5/2022 | Trammell | A47G 19/2205 |
| 2023/0166892 | A1 * | 6/2023 | Iorio | A61J 1/03 215/220 |
| 2024/0358595 | A1 * | 10/2024 | Xie | B65D 83/04 |

* cited by examiner

CONTAINER LID AND CONTAINER

CROSS-REFERENCE TO RELATED APPLICATIONS

This application claims priority to Chinese Patent Application No. 202223020599.4, filed with the Chinese Patent Office on Nov. 14, 2022, titled "CONTAINER LID AND CONTAINER", the entire contents of which are incorporated herein by reference.

TECHNICAL FIELD

Embodiments of the present disclosure relate to the technical field of storage apparatuses, and in particular, relate to a container lid and a container.

BACKGROUND

In a conventional compartmented storage container, by rotatable engagement between an upper lid and a lower lid, an opening of the upper lid is aligned with different storage regions in the container body, and hence pick and place of articles in corresponding storage regions are implemented.

The upper lid and the lower lid are rotatably connected to each other by engagement between a slide block and a slide runway, and thus feel of rotating is poor. In addition, with increase of use time, the slide block inevitably rubs against the slide runway, and a larger gap is caused therebetween. In this way, the upper lid and the lower lid are subject to poor engagement, and consequently normal pick and place of articles in the corresponding storage regions are affected.

SUMMARY

In view of the above problem, embodiments of the present disclosure, provide a container lid and a container, which improve feel of rotating a lid body, and a lid body is prevented from being randomly rotated and thus normal pick and place of articles in corresponding storage regions are ensured.

According to one aspect of the embodiments of the present disclosure, a container lid is provided. The container lid includes: a first lid body and a second lid body; wherein a first end of the first lid body is rotatably connected to the second lid body, and a second end of the first lid body is fixedly connected to a container body; a first wall is arranged at an end portion of the first end of the first lid body, a second wall is arranged at an end portion, facing towards the first lid body, of the second lid body, wherein the first wall is an insertion wall and the second wall is an engagement wall, or the first wall is an engagement wall and the second wall is an insertion wall, the insertion wall being inserted into engagement wall and rotatably connected to the engagement wall; wherein a first snap-fit portion is arranged on the insertion wall, and a plurality of second snap-fit portions are consecutively and evenly arranged on the engagement wall along a circumferential direction, such that the consecutively arranged plurality of second snap-fit portions are successively in snap-fit engagement with the first snap-fit portion when the insertion wall is rotated with respect to the engagement wall; and the first lid body is a hollow structure, an opening is arranged in the second lid body, and the second lid body is configured to cause the opening to be rotated along the circumferential direction to a position corresponding to a storage region in the container body for pick and place of an article in the storage region.

In the container lid according to the embodiments of the present disclosure, by the rotatable connection between the insertion wall and the engagement wall, the first lid body and the second lid body are rotated with respect to each other, and during the rotation, by successive snap-fit engagement between the plurality of second snap-fit portions on the engagement wall and the first snap-fit portion on the insertion wall, a damping effect is achieved. In addition, when the first snap-fit portion is rotated between different second snap-fit portions, clattering sounds are generated and fed back to a user. The damping effect and the clattering sounds during the rotation ensure the feel of rotating by the user, and hence enhance user experience. When the second lid body is rotated to a desired position, the snap-fit engagement between the first snap-fit portion and the second snap-fit portion ensures that the second lid body is not freely rotated, such that pick and place of articles in the corresponding storage regions in the container body are more convenient.

In some embodiments, a plurality of the first snap-fit portions are arranged, and the plurality of the first snap-fit portions are evenly arranged on the insertion wall along the circumferential direction of the insertion wall, and a number of the first snap-fit portions is less than a number of the second snap-fit portions such that each of the first snap-fit portions is in snap-fit engagement with one of the second snap-fit portions when the second lid body is rotated to any position with respect to the first lid body. By snap-fit engagement between each of the first snap-fit portions and one of the second snap-fit portions when the second lid body is rotated to any position, it is ensured that when being stationary, the second lid body is in snap-fit engagement with the first lid body along a circumferential direction at a plurality of evenly spaced points, so as to prevent normal pick and place of the articles from being affected due to free rotation of the second lid body.

In some embodiments, a number of the first snap-fit portions is four, and connection lines between adjacent two of the first snap-fit portions and an axis of the insertion wall define a 90-degree angle. The connection lines between the adjacent two of the four first snap-fit portions and the axis of the insertion wall define a 90-degree angle, such that the insertion wall and the engagement wall are engaged with each other at evenly spaced four positions along the circumferential direction. In this way, it is ensured that the second lid body may not freely rotated, and it is easy and labor-saving for the user to screw the second lid body.

In some embodiments, the first snap-fit portion includes a strip-shaped bump, the strip-shaped bump being parallel to an axis of the insertion wall and an arcuate transition surface being arranged on each of both sides of the strip-shaped bump along the circumferential direction of the insertion wall; and the second snap-fit portion includes a strip-shaped recess, an internal space of the strip-shaped recess being adaptive to an outer profile of the strip-shaped bump in terms of shape, and a gap being defined between the strip-shaped bump and the strip-shaped recess. By arranging the strip-shaped bump and the strip-shaped recess to extend along the axial direction of the insertion wall, when the second lid body is rotated with respect to the first lid body, a contact area between the strip-shaped bump and the strip-shaped recess is increased, such that the damping effect is further enhanced, and the feel of the user in rotating is ensured. By arranging the arcuate transition surfaces on both sides of the strip-shaped bump along the circumferential direction of the insertion wall, and arranging the gap between the strip-shaped bump and the strip-shaped recess, smoothness of the strip-shaped bump in shifting and rotating between different strip-shaped recesses, and smoothness of rotating of the second lid body is ensured.

In some embodiments, an annular bump is arranged on the insertion wall and an annular recess is arranged on the engagement wall, or an annular recess is arranged on the insertion wall and an annular bump is arranged on the engagement wall, wherein the annular bump is rotatably snap-fittable into the annular recess. By rotatably snap-fitting the annular bump into the annular recess, the structure is simplified, and the cost is lowered. In this way, the first lid body and the second lid body are rotatably connected to each other, and the first lid body and the second lid body are limited and fixed along the axial direction.

In some embodiments, the insertion wall is arranged on the first lid body and is integrally formed with the first lid body, and the engagement wall is arranged on the second lid body and is integrally formed with the second lid body. By designing the insertion wall and the first lid body as an integral structure, and designing the engagement wall and the second lid body as an integral structure, during assembly of the container lid, as for manual assembly, the user only needs to hold the first lid body and the second lid body separately with two hands, and then insert the insertion wall on the first lid body into the engagement wall on the second lid body properly to form a rotatable connection, and whereupon the first lid body and the second lid body are assembled. This is quick and convenient, and helps to improve the assembly efficiency.

In some embodiments, the annular bump is arranged on an outer surface of an end, facing away from the first lid body, of the insertion wall, and the annular recess is arranged on an inner surface of an end, adjacent to the second lid body, of the engagement wall. By arranging the annular bump on the outer surface of a tail end of the insertion wall, and arranging the annular recess on the inner surface of a head end of the engagement wall, when the insertion wall is inserted into the engagement wall, the annular bump, at the tail end, is snap-fitted into the annular recess along an axial direction, such that it is ensured that the first lid body is not easily loosen and separated from the second lid body, and hence overall structural stability and reliability of the container lid are ensured.

In some embodiments, a retaining cap mounting portion is arranged at an end, facing away from the first lid body, of the second lid body, wherein the retaining cap mounting portion is configured to be rotatably connected to a retaining cap such that the opening is opened or closed when the retaining cap is rotated. By arranging the retaining cap mounting portion on the second lid body, the retaining cap is rotatably mounted on the retaining cap mounting portion, such that the opening is opened or closed, normal pick and place of the articles in the container body are ensured, and air tightness inside the container body is ensured in article storage.

In some embodiments, a connection portion is arranged on an outer side wall of the first lid body, wherein the connection portion is configured to mount a pendant. By arranging the connection portion on the outer side of the first lid body, mounting of the pendant on the first lid body is achieved.

According to another aspect of the embodiments of the present disclosure, a container is provided. The container includes: a container body, and the container lid as described above, one or more spacers being arranged in the container body; wherein the one or more spacers are configured to partition an inner space of the container body into a plurality of storage regions along a circumferential direction, the first lid body is fixedly connected to the container body, and the second lid body is configured to cause the opening to be rotated along the circumferential direction to a position corresponding to one of the storage regions in the container body for pick and place of an article in the storage region.

In the container according to the embodiments of the present disclosure, by the rotatable connection between the insertion wall and the engagement wall, the first lid body and the second lid body are rotated with respect to each other, and during the rotation, by successive snap-fit engagement between the plurality of second snap-fit portions on the engagement wall and the first snap-fit portion on the insertion wall, a damping effect is achieved. In addition, when the first snap-fit portion is rotated between different second snap-fit portions, clattering sounds are generated and fed back to a user. The damping effect and the clattering sounds during the rotation ensure the feel of rotating by the user, and hence enhance user experience. When the second lid body is rotated to a desired position, the snap-fit engagement between the first snap-fit portion and the second snap-fit portion ensures that the second lid body is not freely rotated, such that pick and place of articles in the corresponding storage regions in the container body are more convenient.

The above description only summarizes the technical solutions of the present disclosure. Specific embodiments of the present disclosure are described hereinafter to better and clearer understand the technical solutions of the present disclosure, to practice the technical solutions based on the disclosure of the specification, and to make the above and other objectives, features and advantages of the present disclosure more apparent and understandable.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference numerals denote like parts. In the drawings.

Figure 1:
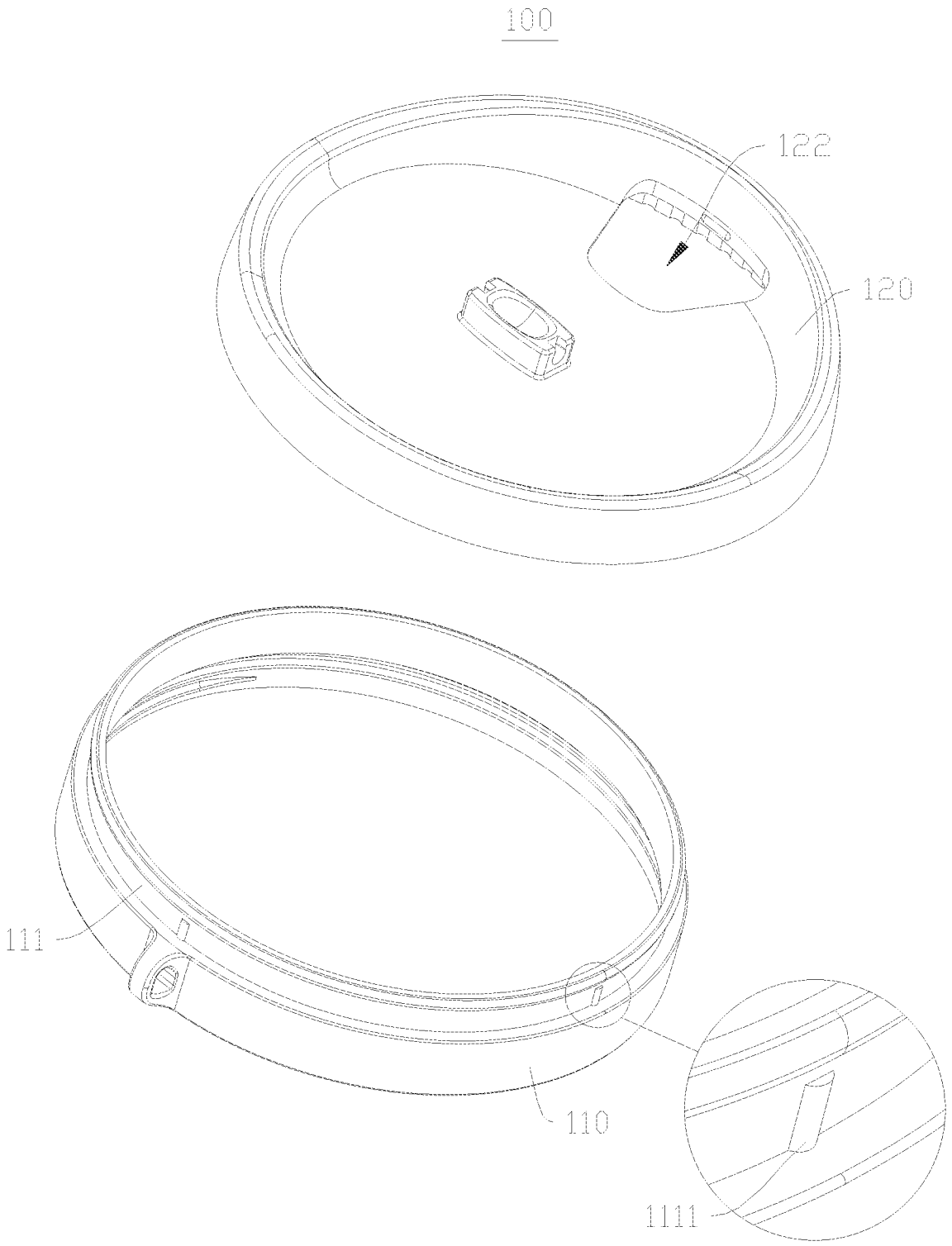
FIG. 1 is a schematic exploded structural view, taken from an angle of view, of a container lid according to some embodiments of the present disclosure.

Reference numerals in the embodiments and denotations thereof:

100—container lid; 110—first lid body; 111—insertion wall; 1111—first snap-fit portion; 1111*a*—strip-shaped bump; 1111*a*1—arcuate transition surface; 1112—annular bump; 112—thread; 113—connection portion; 1131—mounting port; 120—second lid body, 121—engagement wall; 1211— second snap-fit portion; 1211*a*—strip-shaped recess; 1212—annular recess; 122—opening; 123— retaining cap mounting portion; 1231—insertion slot; and

10—container; 200—container body; 210—spacer; 220—storage region; 230—retaining cap.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

Unless defined otherwise, all technical and scientific terms used herein have the same meaning as commonly understood by one of ordinary skill in the art to which the present disclosure pertains. The terms used herein in the specification of present disclosure are only intended to illustrate the specific embodiments of the present disclosure, instead of limiting the present disclosure. The terms "comprise," "include," and any variations thereof in the specification, claims, and the description of the drawings of the present disclosure are intended to cover a non-exclusive inclusion.

In the description of the present disclosure, the terms "first," "second," and the like are only used for distinguishing different objects, but shall not be understood as indication or implication of relative importance or implicit indication of the number of the specific technical features, the specific sequence or priorities. In the description of the embodiments of the present disclosure, the term "multiple" or "a plurality of" signifies at least two, unless otherwise specified.

The terms "example" and "embodiment" in this specification signify that the specific characteristic, structures or features described with reference to the embodiments may be covered in at least one embodiment of the present disclosure. This term, when appearing in various positions of the description, neither indicates the same embodiment, nor indicates an independent or optional embodiment that is exclusive of the other embodiments. A person skilled in the art would implicitly or explicitly understand that the embodiments described in this specification may be incorporated with other embodiments.

In the description of the embodiments of the present disclosure, the term "and/or" is merely an association relationship for describing associated objects, which represents that there may exist three types of relationships, for example, A and/or B may represent three situations: only A exists, both A and B exist, and only B exists. In addition, the forward-slash symbol "/" generally represents an "or" relationship between associated objects before and after the symbol.

In the description of the embodiments of the present disclosure, the term "multiple" or "a plurality of" signifies more than two (including two), unless otherwise specified. Likewise, the term "a plurality of groups" or "multiple groups" signifies more than two groups (including two groups), and the term "a plurality of pieces" or "multiple pieces" signifies more than two pieces (including two pieces).

In the description of the embodiments of the present disclosure, it should be understood that the terms "central," "transversal," "longitudinal," "length," "width," "thickness," "upper," "lower," "front," "rear," "left," "right," "vertical," "horizontal," "top," "bottom," "inner," "outer," "clockwise," "counterclockwise," "axial," "radial," "circumferential," and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In the description of the embodiments of the present disclosure, it should be noted that unless otherwise specified and defined, the terms "mounted," "coupled," "connected," "secured," and derivative forms thereof shall be understood in a broad sense, which, for example, may be understood as secured connection, detachable connection or integral connection; may be understood as mechanical connection or electrical connection, or understood as direct connection, indirect connection via an intermediate medium, or communication between the interiors of two elements or interactions between two elements. Persons of ordinary skill in the art may understand the specific meanings of the above terms in the embodiments of the present disclosure according to the actual circumstances and contexts.

In a conventional compartmented storage container, feel in rotating is poor when an upper lid and a lower lid are rotated with respect to each other, and upon a long time of use, since some wear is caused to a slidable engagement structure, the upper lid and the lower lid are in loose engagement. As a result, when the container is moved or a user accidentally touches the upper lid with hands, the upper lid is freely rotated due to excessive flexibility, and consequently normal pick and place of articles in corresponding storage regions in the container body are affected.

Accordingly, some embodiments of the present disclosure provide a container lid. By a rotatable connection between an insertion wall and an engagement wall, a first lid body and a second lid body are rotated with respect to each other, and during the rotation, by successive snap-fit engagement between a plurality of second snap-fit portions on the engagement wall and a first snap-fit portion on the insertion wall, a damping effect is achieved. In addition, when the first snap-fit portion is rotated between different second snap-fit portions, due to squeezing and bumping, clattering sounds are generated and fed back to a user. A damping effect and clattering sounds during the rotation ensure feel of rotating by the user, and hence enhance user experience. When the second lid body is rotated to a desired position, the snap-fit engagement between the first snap-fit portion and the second snap-fit portion ensures that the second lid body is not freely rotated, such that pick and place of articles in the corresponding storage regions in the container body are more convenient.

The container lid according to the embodiments of the present disclosure includes, but is not limited to, application to water bottles, medicine bottles, storage boxes, and the like containers.

Figure 2:
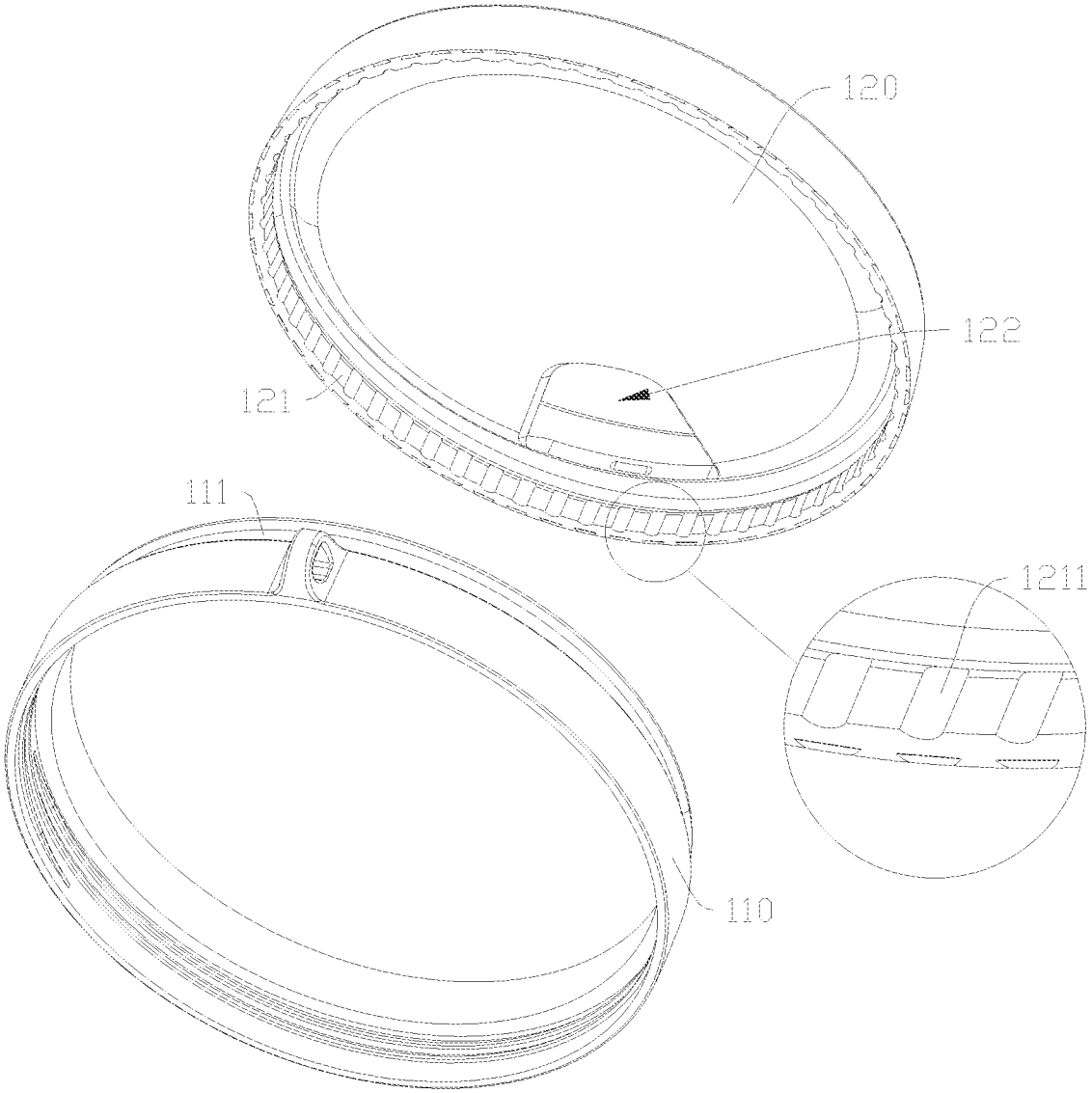
FIG. 2 is a schematic exploded structural view, taken from another angle of view, of the container lid according to some embodiments of the present disclosure.

Specifically, referring to FIG. 1 and FIG. 2, FIG. 1 and FIG. 2 respectively illustrate exploded structures of a container lid 100 according to the embodiments of the present disclosure from two view angles. As illustrated in FIG. 1 and FIG. 2, the container lid 100 includes a first lid body 110 and a second lid body 120. One end of the first lid body 110 is rotatably connected to the second lid body 120, and the other end of the first lid body 110 is fixedly connected to a container body. Of two opposing end portions of the first lid body 110 and the second lid body 120, one end portion is provided with an insertion wall 111, and the other end portion is provided with an engagement wall 121. The insertion wall 111 is inserted into the engagement wall 121, and is rotatably connected to the engagement wall 121. A first snap-fit portion 1111 is arranged on the insertion wall 111, and a plurality of second snap-fit portions 1211 are consecutively and evenly arranged on the engagement wall 121 along a circumferential direction, such that the consecutively arranged plurality of second snap-fit portions 1211 are successively in snap-fit engagement with the first snap-fit portion 1111 when the insertion wall 111 is rotated with respect to the engagement wall 121. The first lid body 110 is a hollow structure, an opening 122 is arranged in the second lid body 120, and the second lid body 120 is configured to cause the opening 122 to be rotated along the circumferential direction to a position corresponding to a storage region in the container body for pick and place of an article in the storage region.

As illustrated in FIG. 1 and FIG. 2, threads 112 may be arranged in an inner side wall of the first lid body 110, and the first lid body 110 is screwed and fixed to an article inlet and outlet portion of the container body via the threads 112.

Figure 3:
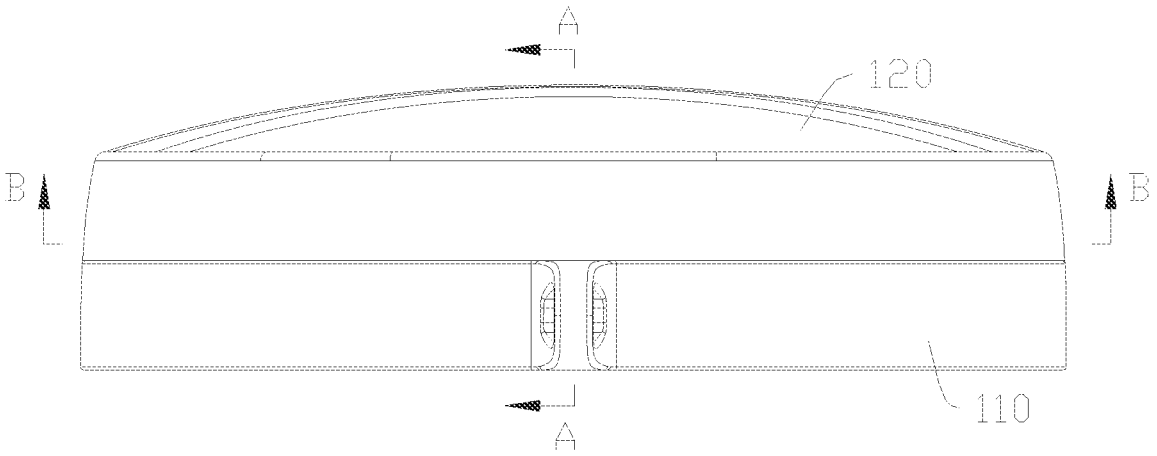
FIG. 3 is a schematic structural view, taken from a side angle of view, of the container lid according to some embodiments of the present disclosure.
Figure 4:
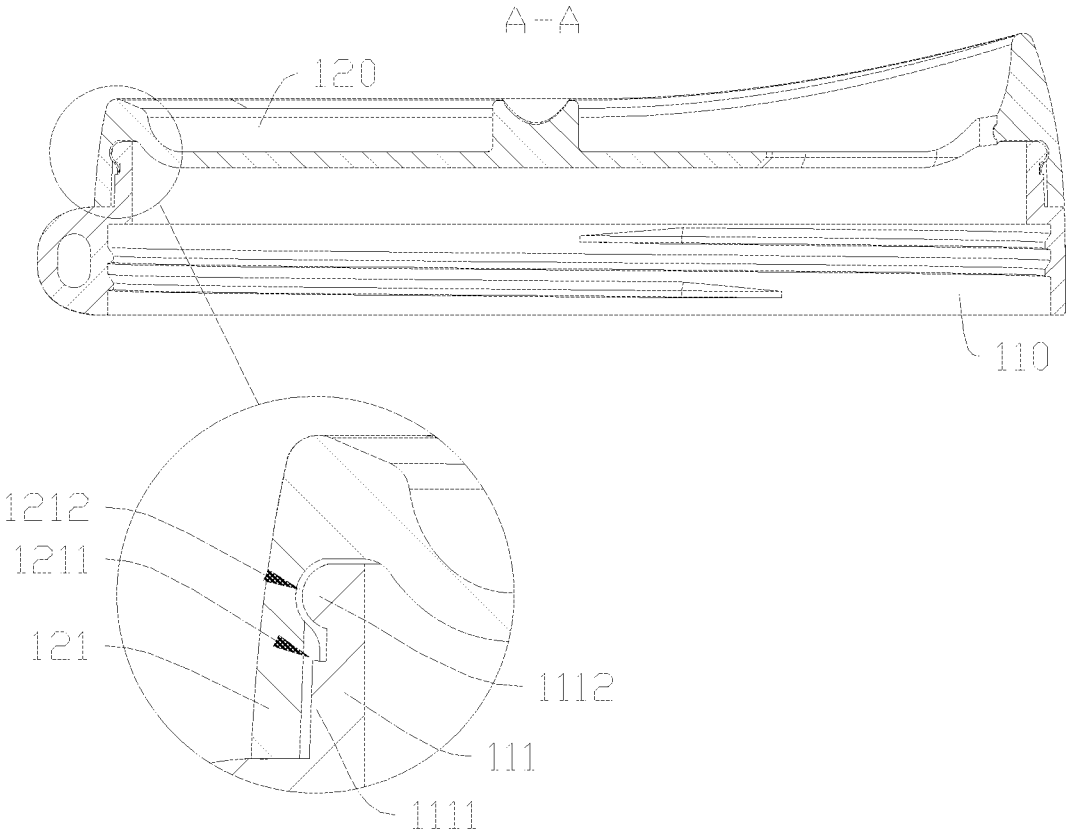
FIG. 4 is a schematic sectional view taken along an A-A line of the structure in FIG. 3.

For details about the engagement between the insertion wall 111 and the engagement wall 121, and the engagement between the first snap-fit portion 1111 and the second snap-fit portion 1211, reference may be made to FIG. 3 and FIG. 4. FIG. 3 illustrates a structure of the container lid from a side angle of view, and FIG. 4 illustrates a sectional view taken along an A-A line of the structure in FIG. 3. As illustrated in FIG. 1 and FIG. 2, during assembly, when the insertion wall 111 is properly inserted into the engagement wall 121, by snap-fitting between a bump and a slide runway, the first lid body 110 and the second lid body 120 are relatively fixed along an insertion direction. In addition, by engagement between the bump and the slide runway, a user can screw the second lid body 120 to cause the second lid body 120 to be rotated with respect to the first lid body 110, such that the opening 122 is aligned with different storage regions in the container body to facilitate pick and place of articles in corresponding storage regions.

Figure 5:
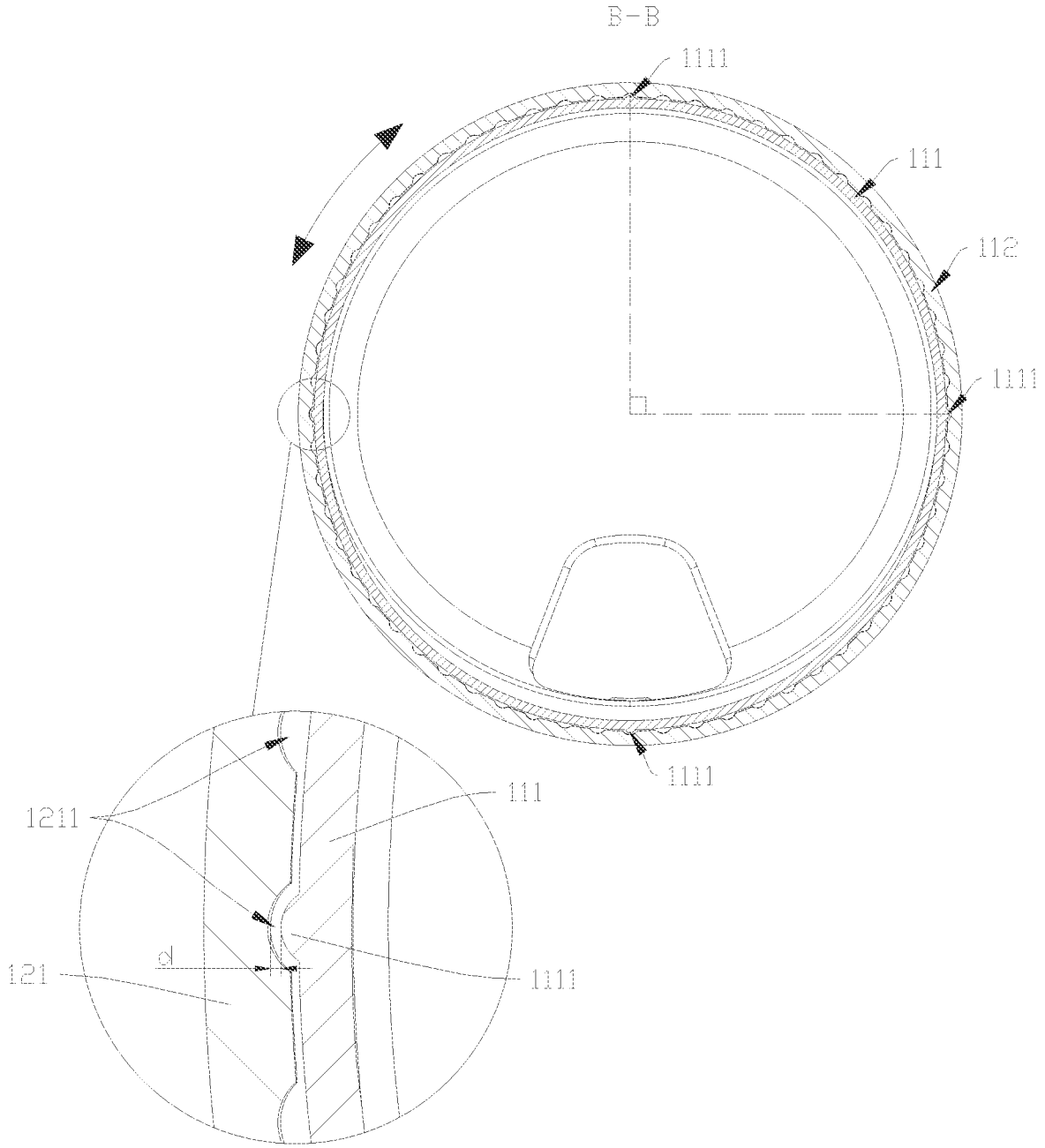
FIG. 5 is a schematic sectional view taken along a B-B' line of the structure in FIG. 3.

Further, still referring to FIG. 5, a sectional view taken from a B-B line of the structure in FIG. 3 is illustrated. As illustrated in FIG. 5, when the insertion wall 111 is inserted into the engagement wall 121, the first snap-fit portion 1111 is in snap-fit engagement with one of the second snap-fit portions 1211, such that the second lid body 120 is limited along the circumferential direction, and hence the second lid body 120 is prevented from free rotation. When the second lid body 120 is screwed along a direction indicated by the arrow in FIG. 5, the plurality of second snap-fit portions 1211 are rotated with the engagement wall 121, and are successively in snap-fit engagement with the first snap-fit portion 1111, thereby achieving a damping effect. In addition, due to squeezing and bumping between the first snap-fit portion 1111 and the plurality of second snap-fit portions 1211, clattering sounds are generated, which creates a mechanical feel, and gives rotation feedback to hands of the user. When the second lid body 120 is rotated to a desired position, the first snap-fit portion 1111 and the corresponding second snap-fit portion 1211 are in snap-fit engagement, such that the second lid body 120 is limited to the desired position, and normal pick and place of the articles in the corresponding storage regions are ensured.

In the container 100 according to the embodiments of the present disclosure, by the rotatable connection between the insertion wall 111 and the engagement wall 121, the first lid body 110 and the second lid body 120 are rotated with respect to each other, and during the rotation, by successive snap-fit engagement between the plurality of second snap-fit portions 1211 on the engagement wall 121 and the first snap-fit portion 1111 on the insertion wall 111, a damping effect is achieved. In addition, when the first snap-fit portion 1111 is rotated between different second snap-fit portions 1211, clattering sounds are generated and fed back to a user. The damping effect and the clattering sounds during the rotation ensure the feel of rotating by the user, and hence enhance user experience. When the second lid body 120 is rotated to a desired position, the snap-fit engagement between the first snap-fit portion 1111 and the second snap-fit portion 1211 ensures that the second lid body 120 is not freely rotated, such that pick and place of articles in the corresponding storage regions in the container body are more convenient.

For reliable limitation of the second lid body 120 at the desired position along the circumferential direction, the present disclosure further provides an embodiment. Still referring to FIG. 5, a plurality of first snap-fit portions 1111 are provided, and the plurality of first snap-fit portions 1111 are evenly arranged on the first insertion wall 111 along the circumferential direction (the direction indicated by the arrow in FIG. 5) of the insertion wall 111. A number of the first snap-fit portions 1111 is less than a number of the second snap-fit portions 1211, such that each of the first snap-fit portions 1111 is in snap-fit engagement with one of the second snap-fit portions 1211 when the second lid body 120 is rotated to any position with respect to the first lid body 110.

It may be understood that two first snap-fit portions 1111 may be symmetrically arranged along a diameter direction of the insertion wall 111, or three first snap-fit portions 1111 may be arranged in a triangular shape. Nevertheless, more first snap-fit portions 1111 may be arranged with connection lines therebetween in a square shape or a polygonal shape as long as the insertion wall 111 and the engagement wall 121 are snap-fitted to each other at several evenly spaced positions. The specific number of first snap-fit portions 111 is not limited herein.

By snap-fit engagement between each of the first snap-fit portions 1111 and one of the second snap-fit portions 1211 when the second lid body 120 is rotated to any position, it is ensured that when being stationary, the second lid body 120 is in snap-fit engagement with the first lid body 110 along the circumferential direction at a plurality of evenly spaced points, so as to prevent normal pick and place of the articles from being affected due to free rotation of the second lid body 120.

Further, still referring to FIG. 5, in some embodiments, a number of the first snap-fit portions 1111 is four, and connection lines between adjacent two of the first snap-fit portions 1111 and an axis of the insertion wall 111 define a 90-degree angle.

Specifically, the number of first snap-fit portions 1111 is four, and according to the orientations in FIG. 5, the four first snap-fit portions 1111 are arranged at upper, lower, left, and right positions in mirror configuration (that is, the connection lines between the adjacent two of the four first snap-fit portions 1111 and the axis of the insertion wall 111 define a 90-degree angle), such that the insertion wall 111 and the engagement wall 121 are engaged with each other at the evenly spaced four positions along the circumferential direction. In this way, it is ensured that the second lid body 120 may not be freely rotated, and it is easy and labor-saving for the user to screw the second lid body 120.

Figure 6:
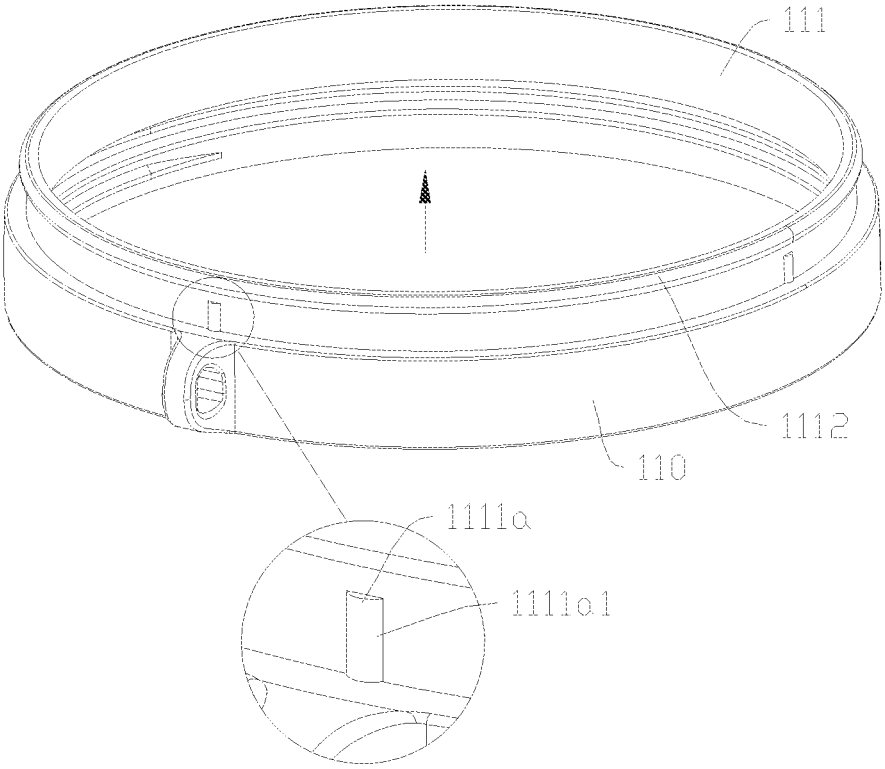
FIG. 6 is a schematic structural view of a first lid body in the container lid according to some embodiments of the present disclosure.
Figure 7:
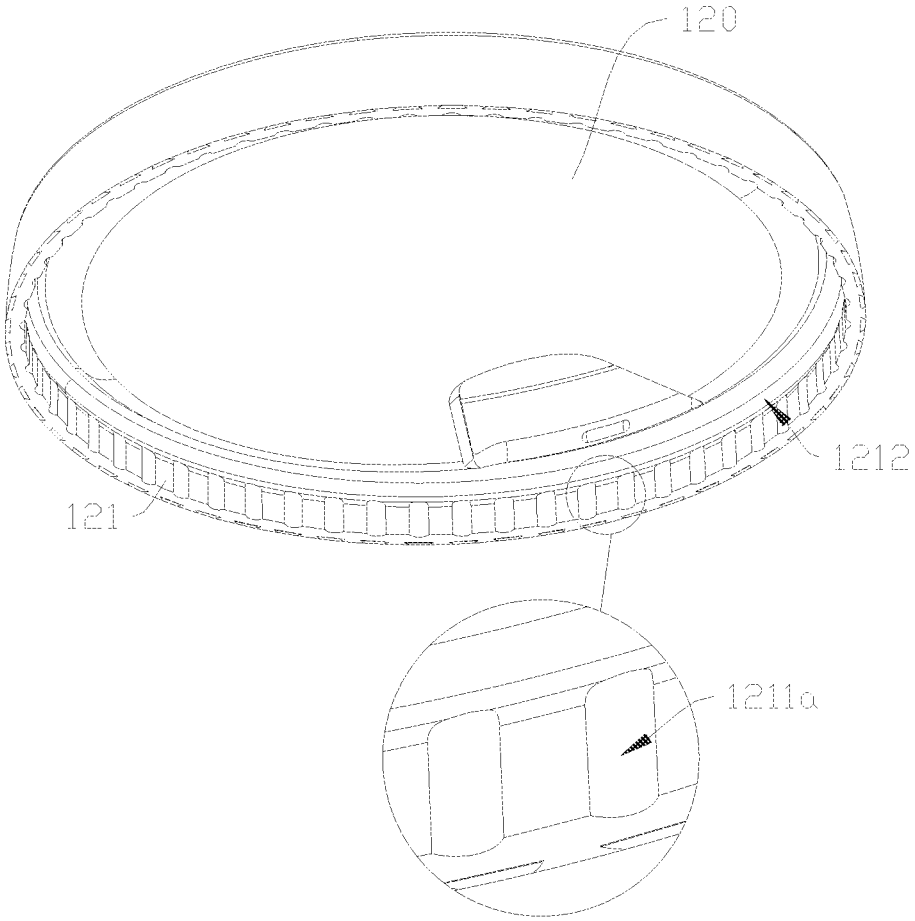
FIG. 7 is a schematic structural view of a second lid body in the container lid according to some embodiments of the present disclosure.

With respect to the specific structures of the first snap-fit portion 1111 and the second snap-fit portion 1211, the present disclosure provides an embodiment. Referring to FIG. 6 and FIG. 7, the structures of the first lid body 110 and the second lid body 120 are illustrated. As illustrated in FIG. 6 and FIG. 7, the first snap-fit portion 1111 includes a plurality of strip-shaped bumps 1111*a*. The strip-shaped bumps 1111*a* are parallel to an axial direction (the direction indicated by the arrow in FIG. 6) of the insertion wall 111, and an arcuate transition surface 1111*a*1 is arranged on each of both sides of the strip-shaped bump 1111*a* along the circumferential direction (the direction indicated by the arrow in FIG. 5) of the insertion wall 111. The second snap-fit portion 1211 includes a strip-shaped recess 1211*a*. An internal space of the strip-shaped recess 1211*a* is adaptive to an outer profile of the strip-shaped bump 1111*a* in terms of shape, and a gap d (as illustrated in FIG. 5) is defined between the strip-shaped bump 1111*a* and the strip-shaped recess 1211*a*.

By arranging the strip-shaped bump 1111*a* and the strip-shaped recess 1211*a* to extend along the axial direction of the insertion wall 111, when the second lid body 120 is rotated with respect to the first lid body 110, a contact area between the strip-shaped bump 1111*a* and the strip-shaped recess 1211*a* is increased, such that the damping effect is further enhanced, and the feel of the user in rotating is ensured. By arranging the arcuate transition surfaces on both sides of the strip-shaped bump 1111*a* along the circumferential direction of the insertion wall 111, and arranging the gap between the strip-shaped bump 1111*a* and the strip-shaped recess 1211*a*, smoothness of the strip-shaped bump 1111*a* in shifting and rotating between different strip-shaped recesses 1211*a*, and smoothness of rotating of the second lid body 120 is ensured.

With respect to the rotatable connection structure between the insertion wall 111 and the engagement wall 121, the present disclosure further provides an embodiment. Still further referring to FIG. 4, FIG. 6, and FIG. 7, one of the insertion wall 111 and the engagement wall 121 is provided with an annular bump 1112, and the other of the insertion wall 111 and the engagement wall 121 is provided with an annular recess 1212. The annular bump 1112 is rotatably snap-fitted into the annular recess 1212.

By rotatably snap-fitting the annular bump 1112 into the annular recess 1212, the structure is simplified, and the cost is lowered. In this way, the first lid body 110 and the second lid body 120 are rotatably connected to each other, and the first lid body 110 and the second lid body 120 are limited and fixed along the axial direction (the direction indicated by the arrow in FIG. 6).

As illustrated in FIG. 4, in some embodiments, the insertion wall 111 is arranged on the first lid body 110 and is integrally formed with the first lid body 110, and the engagement wall 121 is arranged on the second lid body 120 and is integrally formed with the second lid body 120.

By designing the insertion wall 111 and the first lid body 110 as an integral structure, and designing the engagement wall 121 and the second lid body 120 as an integral structure, during assembly of the container lid 100, as for manual assembly, the user only needs to hold the first lid body 110 and the second lid body 120 separately with two hands, and then insert the insertion wall 111 on the first lid body 110 into the engagement wall 121 on the second lid body 120 properly to form a rotatable connection, and whereupon the first lid body 110 and the second lid body 120 are assembled. This is quick and convenient, and helps to improve the assembly efficiency.

Further, still referring to FIG. 4, in some embodiments, the annular bump 1112 is arranged on an outer surface of an end, facing away from the first lid body 110, of the insertion wall 111, and the annular recess 1212 is arranged on an inner surface of an end, adjacent to the second lid body 120, of the engagement wall 121.

By arranging the annular bump 1112 on the outer surface of a tail end of the insertion wall 111, and arranging the annular recess 1212 on the inner surface of a head end of the engagement wall 121, when the insertion wall 111 is inserted into the engagement wall 121, the annular bump 11112, at the tail end, is snap-fitted into the annular recess 1212 along the axial direction (the direction indicated by the arrow in FIG. 6), such that it is ensured that the first lid body 110 is not easily loosen and separated from the second lid body 120, and hence overall structural stability and reliability of the container lid 100 are ensured.

Figure 8:
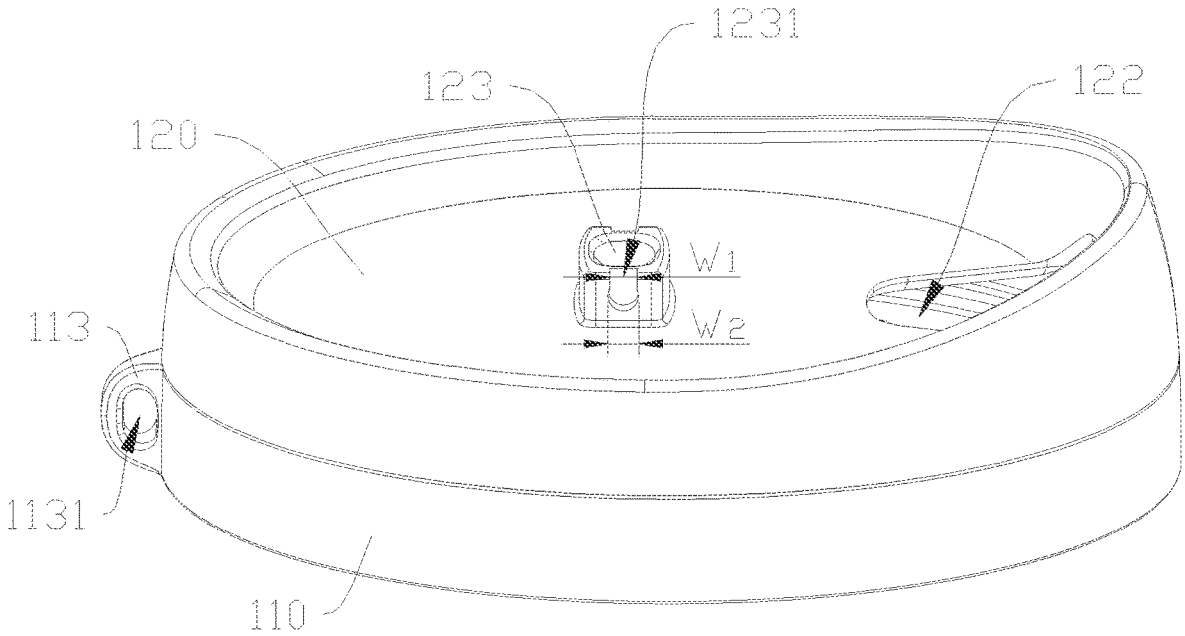
FIG. 8 is a schematic structural view of the container lid according to some embodiments of the present disclosure.
Figure 9:
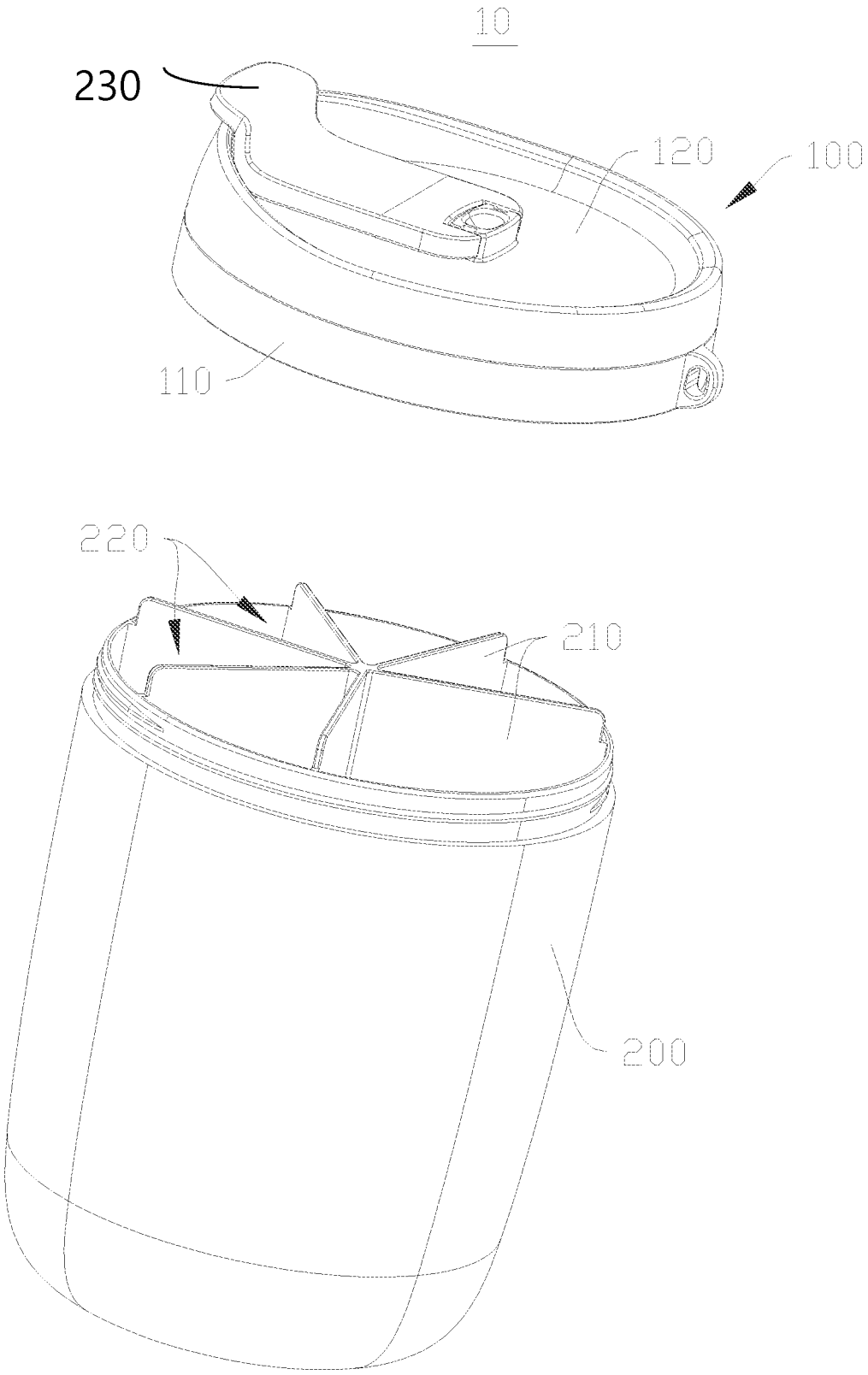
FIG. 9 is a schematic structural view of a container according to some embodiments of the present disclosure.

For air tightness of the container body when the container lid 100 is mounted on the container body, the present disclosure further provides an embodiment. Referring to FIG. 8, a structure of the container lid from an angle of view is illustrated. As illustrated in FIG. 8, a retaining cap mounting portion 123 is arranged at an end, facing away from the first lid body 110, of the second lid body 120, wherein the retaining cap mounting portion 123 is configured to be rotatably connected to a retaining cap 230 (as illustrated in FIG. 9) such that the opening 122 is opened or closed when the retaining cap 230 is rotated.

Specifically, as illustrated in FIG. 8, the opening 122 may be arranged at an edge position of the second lid body 120, the retaining cap mounting portion 123 is arranged at a middle position of the second lid body 120, and an insertion slot 1231 is arranged on each of both sides of the retaining cap mounting portion 123. A width $W_1$ at a mouth of the insertion slot 1231 is less than a width $W_2$ at a bottom of the insertion slot 1231, such that a rotation shaft on the retaining cap is pressed downwards from the mouth of the insertion slot 1231 into the bottom of the insertion slot 1231 to form a rotatable snap-fit engagement with the bottom of the insertion slot 1231. In this way, the opening 122 may be closed or opened by rotating the retaining cap.

By arranging the retaining cap mounting portion 123 on the second lid body 120, the retaining cap is rotatably mounted on the retaining cap mounting portion 123, such that the opening 122 is opened or closed, normal pick and place of the articles in the container body are ensured, and air tightness inside the container body is ensured in article storage.

Still referring to FIG. 8, in some embodiments, a connection portion 113 is arranged on an outer side of the first lid body 110. The connection portion 113 is configured to mount a pendant.

Specifically, as illustrated in FIG. 8, the connection portion 113 may be a bump formed by extending outwards an outer wall of the first lid body 110, and a mounting port 1131 is defined in the connection portion 113. The mounting port 1131 is configured to allow a lanyard to travel therethrough and be connected to the connection portion 113. The pendant may be a single lanyard which facilitates lifting and carrying the container, or may be a pendant or ornament having a lanyard to enhance an aesthetic measure of the container.

By arranging the connection portion 113 on the outer side of the first lid body 110, mounting of the pendant on the first lid body 110 is achieved.

According to another aspect of the embodiments of the present disclosure, a container 10 is provided. Specifically, still referring to FIG. 9, an exploded structure of the container 10 is illustrated. As illustrated in FIG. 9, the container 10 includes: a container body 200, and the container lid 100 as described above, one or more spacers 210 being arranged in the container body 200; wherein the one or more spacers 210 are configured to partition an inner space of the container body 200 into a plurality of storage regions 220 along a circumferential direction, the first lid body 110 is fixedly connected to the container body 200, and the second lid body 120 is configured to cause the opening to be rotated along the circumferential direction to a position corresponding to one of the storage regions 220 for pick and place of an article in the storage region 220.

In the container 10 according to the embodiments of the present disclosure, by the rotatable connection between the insertion wall 111 and the engagement wall 121, the first lid body 110 and the second lid body 120 are rotated with respect to each other, and during the rotation, by successive snap-fit engagement between the plurality of second snap-fit portions 1211 on the engagement wall 121 and the first snap-fit portion 1111 on the insertion wall 111, a damping effect is achieved. In addition, when the first snap-fit portion 1111 is rotated between different second snap-fit portions 1211, clattering sounds are generated and fed back to a user. The damping effect and the clattering sounds during the rotation ensure the feel of rotating by the user, and hence enhance user experience. When the second lid body 120 is rotated to a desired position, the snap-fit engagement between the first snap-fit portion 1111 and the second snap-fit portion 1211 ensures that the second lid body 120 is not freely rotated, such that pick and place of articles in the corresponding storage regions 220 in the container body 200 are more convenient.

It should be finally noted that the above-described embodiments are merely for illustration of the present disclosure, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope defined by the claims and the specification of the present disclosure. Especially, various technical features mentioned in various embodiments may be combined in any fashion as long as there is no structural conflict. The present disclosure is not limited to the specific embodiments described herein in this specification, but also includes all the technical solutions falling within the scope subject to the appended claims.

What is claimed is:

1. A container, comprising:

a container body and a container lid, wherein the container lid comprises:

a first lid body and a second lid body;

wherein a first end of the first lid body is rotatably connected to the second lid body, and a second end of the first lid body is fixedly connected to a container body;

a first wall is arranged at an end portion of the first end of the first lid body, a second wall is arranged at an end portion, facing towards the first lid body, of the second lid body, wherein the first wall is an insertion wall and the second wall is an engagement wall, or the first wall is an engagement wall and the second wall is an insertion wall, the insertion wall being inserted into the engagement wall and rotatably connected to the engagement wall;

wherein a first snap-fit portion is arranged on the insertion wall, and a plurality of second snap-fit portions are consecutively and evenly arranged on the engagement wall along a circumferential direction, such that the consecutively arranged plurality of second snap-fit portions are successively in snap-fit engagement with the first snap-fit portion when the insertion wall is rotated with respect to the engagement wall; and the first lid body is an annular structure with a hollow center, an opening is arranged in the second lid body;

wherein one or more spacers being arranged in the container body;

wherein the one or more spacers are configured to partition an inner space of the container body into a plurality of storage regions along a circumferential direction, the first lid body is fixedly connected to the container body, the hollow center of the first lid is in communication with all of the plurality of storage regions, and the second lid body is configured to be rotated to cause the opening to be aligned with one of the storage regions in the container body for pick and place of an article in the storage region via the hollow center of the first lid.

2. The container according to claim 1, wherein a plurality of the first snap-fit portions are arranged, and the plurality of the first snap-fit portions are evenly arranged on the insertion wall along the circumferential direction of the insertion wall, and a number of the first snap-fit portions is less than a number of the second snap-fit portions such that each of the first snap-fit portions is in snap-fit engagement with one of the second snap-fit portions when the second lid body is rotated to a position with respect to the first lid body.

3. The container according to claim 2, wherein a number of the first snap-fit portions is four, and connection lines between adjacent two of the first snap-fit portions and an axis of the insertion wall define a 90-degree angle.

4. The container according to claim 1, wherein the first snap-fit portion comprises a strip-shaped bump, the strip-shaped bump being parallel to an axis of the insertion wall and an arcuate transition surface being arranged on each of both sides of the strip-shaped bump along the circumferential direction of the insertion wall; and the second snap-fit portion comprises a strip-shaped recess, an internal space of the strip-shaped recess being adaptive to an outer profile of the strip-shaped bump in terms of shape, and a gap being defined between the strip-shaped bump and the strip-shaped recess.

5. The container according to claim 1, wherein an annular bump is arranged on the insertion wall and an annular recess is arranged on the engagement wall, or an annular recess is arranged on the insertion wall and an annular bump is arranged on the engagement wall, wherein the annular bump is rotatably snap-fittable into the annular recess.

6. The container according to claim 5, wherein the insertion wall is arranged on the first lid body and is integrally formed with the first lid body, and the engagement wall is arranged on the second lid body and is integrally formed with the second lid body.

7. The container according to claim 6, wherein the annular bump is arranged on an outer surface of an end, facing away from the first lid body, of the insertion wall, and the annular recess is arranged on an inner surface of an end, adjacent to the second lid body, of the engagement wall.

8. The container according to claim 1, wherein a retaining cap mounting portion is arranged at a second end, facing away from the first lid body, of the second lid body, wherein the retaining cap mounting portion is configured to be connected to a retaining cap such that the opening is opened or closed when the retaining cap is rotated.

9. The container according to claim 8, wherein the opening is arranged at an edge position of the second lid body, the retaining cap mounting portion is arranged at a middle position of the second lid body, and two insertion slots are arranged on opposite sides of the retaining cap mounting portion, a width at a mouth of the insertion slot being less than a width at a bottom of the insertion slot.

10. The container according to claim 1, wherein a connection portion is arranged on an outer side wall of the first lid body, wherein the connection portion is configured to mount a pendant.

* * * * *